US008157578B2

(12) United States Patent
Lee

(10) Patent No.: US 8,157,578 B2
(45) Date of Patent: Apr. 17, 2012

(54) UNIVERSAL PLUG ADAPTER WITH MULTIPLE RETRACTABLE PIN PLUGS

(76) Inventor: Kuang-Hao Lee, Guang Dong (CN)

( * ) Notice: Subject to any disclaimer, the term of this patent is extended or adjusted under 35 U.S.C. 154(b) by 0 days.

(21) Appl. No.: 12/779,558

(22) Filed: May 13, 2010

(65) Prior Publication Data

US 2010/0311261 A1 Dec. 9, 2010

(51) Int. Cl.
*H01R 27/00* (2006.01)

(52) U.S. Cl. ..... 439/223; 439/172

(58) Field of Classification Search ..... 439/223, 439/170, 171, 172, 173, 174, 131
See application file for complete search history.

(56) References Cited

U.S. PATENT DOCUMENTS 2,163,201 A * 6/1939 Kalencik ..... 439/172
3,025,486 A * 3/1962 Falconer ..... 439/103
4,626,052 A * 12/1986 Rumble ..... 439/173
6,923,666 B1 * 8/2005 Liao ..... 439/172
7,445,513 B1 * 11/2008 Lee ..... 439/652

* cited by examiner

*Primary Examiner* — Hae Moon Hyeon
(74) *Attorney, Agent, or Firm* — Alexander Chen, Esq

(57) ABSTRACT

An universal plug adapter with multiple retractable pin plugs, comprising: a main body, at least a set of pin plug, an orientation guide rod allowing sliding of pin plug and a slide block restricting the shift of pin plug; the pin plug comprises of at least a pair of pins of international standard size, of which a single pin plug can be pushed every time; a sliding groove is set laterally onto the slide block; the groove is deep upwards and shallow downwards; the pin plug is provided with a bulge; when the pin plug is pushed, the bulge moves along the groove of the slide block groove; given the different depth of the groove, the bulge pushes the slide block to shift, such that the bulges on other pin plug cannot be aligned with the center of the groove, so other pin plugs not yet pushed are restricted in original position.

6 Claims, 6 Drawing Sheets

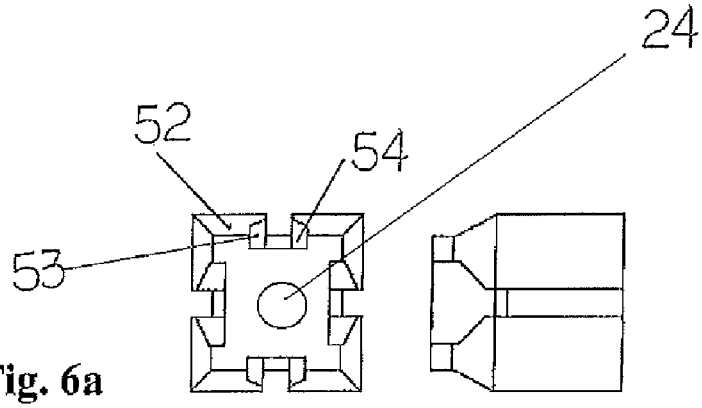
Fig. 6a
Fig. 6b
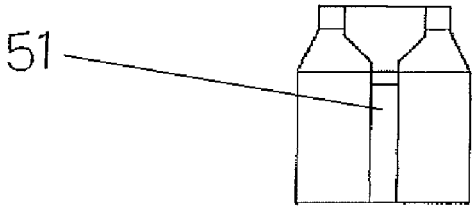
Fig. 6c
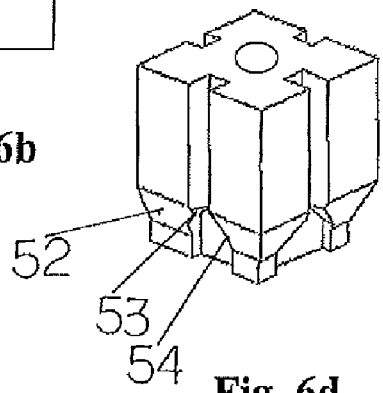
Fig. 6d
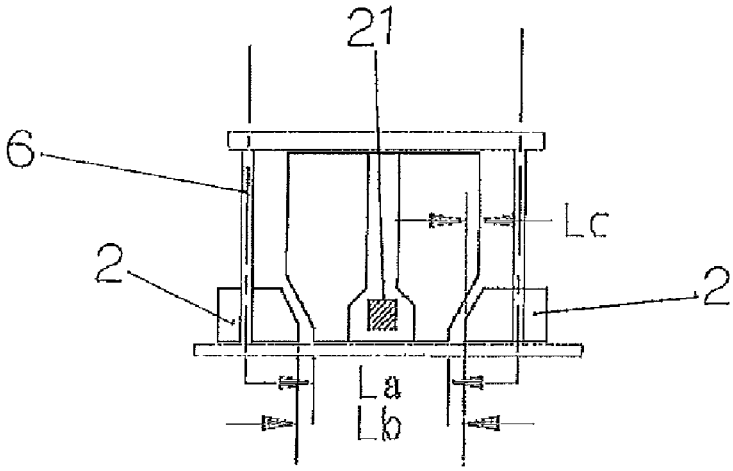
Fig. 7

UNIVERSAL PLUG ADAPTER WITH MULTIPLE RETRACTABLE PIN PLUGS

BACKGROUND OF INVENTION

1. Field of the Invention

The present invention relates generally to a plug adapter, and more particularly to an innovative one which is designed with multiple international standard retractable pin plugs that can be used individually.

2. Description of Related Art

Conventional plug adapters are generally provided with a permanent pin, which is only mated with a plug jack. Yet, there are a variety of plug jacks, such as: flat, round, square and oblique, making it difficult for the permanent pin to meet the requirements. Hence, the conventional plug adapters are restricted by simple functions, limited applications and inconveniency.

SUMMARY OF INVENTION

The primary objective of the invention is to provide a universal plug adapter with multiple international standard retractable pin plugs, wherein the slide block and multiple retractable pins are mated to overcome the shortcomings of existing plug adapter, making it possible to adapt to different plug jacks.

The technical package of the present invention is: the adapter comprises a main body, at least a set of pin plug, an orientation guide rod allowing sliding of pin plug and a slide block restricting the shift of pin plug; the pin plug comprises of at least two pins of an international standard size, of which only a single pin plug can be pushed every time; a sliding groove is set laterally onto the slide block; the groove is deep upwards and shallow downwards; said slide block is also provided with an inner oblique surface at lower portion and adjacent to the sliding groove; and said sliding groove is provided with a first groove oblique surface and a second groove oblique surface; the pin plug is provided with a groove matching bulge and an inner oblique surface matching external oblique surface; when the pin plug is pushed, the bulge and the external oblique surface moves along the groove and the inner oblique surface of the slide block; given the different depth of the groove, the bulge pushes the slide block to shift, such that the bulges on other pin plugs cannot be aligned with the center of the groove, so other pin plugs not yet pushed are restricted in original position; said slide block is arranged at the center of the pin plug configuration, whilst a groove of different depth is arranged at three or four sides of the slide block.

The technical package also comprises:

said slide block can be hollow, wherein fuse or indicator can be installed.

said slide block can be cylindrical, and provided with at least three grooves; each groove has different depth.

said main body can be provided with a plug socket.

said main body can be provided with an alternating current/direct current (AC/DC) plug module internally, whilst an output of Universal Serial Bus (USB) is arranged externally.

The inner oblique surface is placed at lower end at one side of said slide block, and the external oblique surface is located at the bulge of the pin plug; said external oblique surface is mated with said inner oblique surface.

Said lower cover plate is provided with orientation guide rod allowing the sliding of pin plug.

Advantages of the present invention include: multiple retractable pin plugs are arranged to realize diversified functions, operate easily and save the cost through the simple structure.

BRIEF DESCRIPTION OF THE DRAWINGS

FIG. 6*a*~6*d*: structural views of slide block of FIG. 2; and

FIG. 7: a sectional view of FIG. 2, showing the relative position of the slide block and retractable pin plug.

DETAILED DESCRIPTION OF INVENTION

Figure 1:
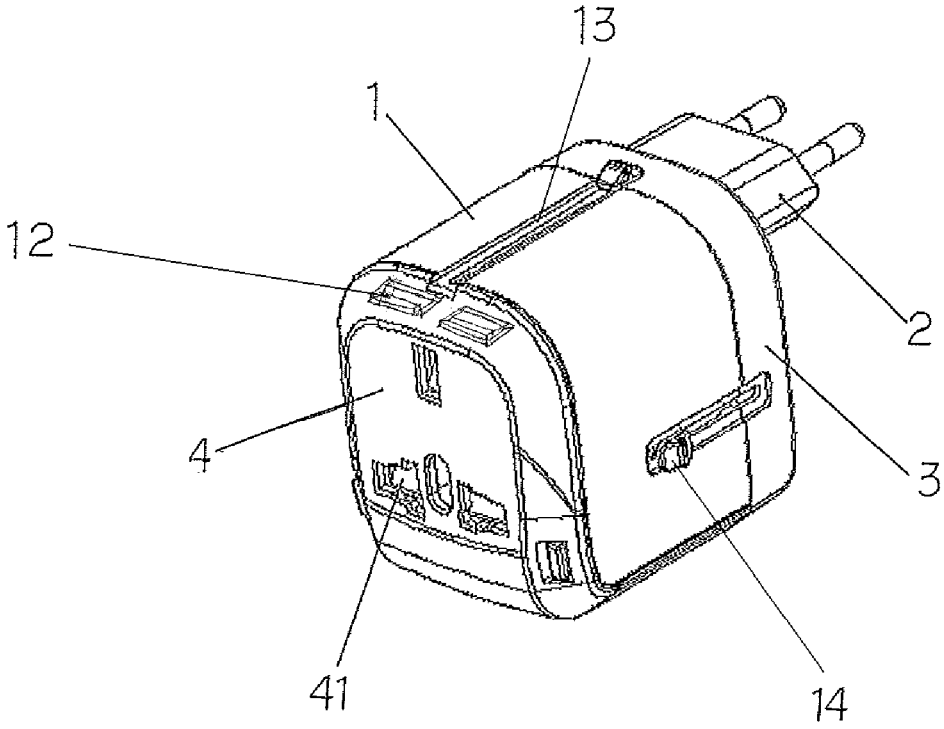
FIG. 1: a structural view of the present invention.
Figure 2:
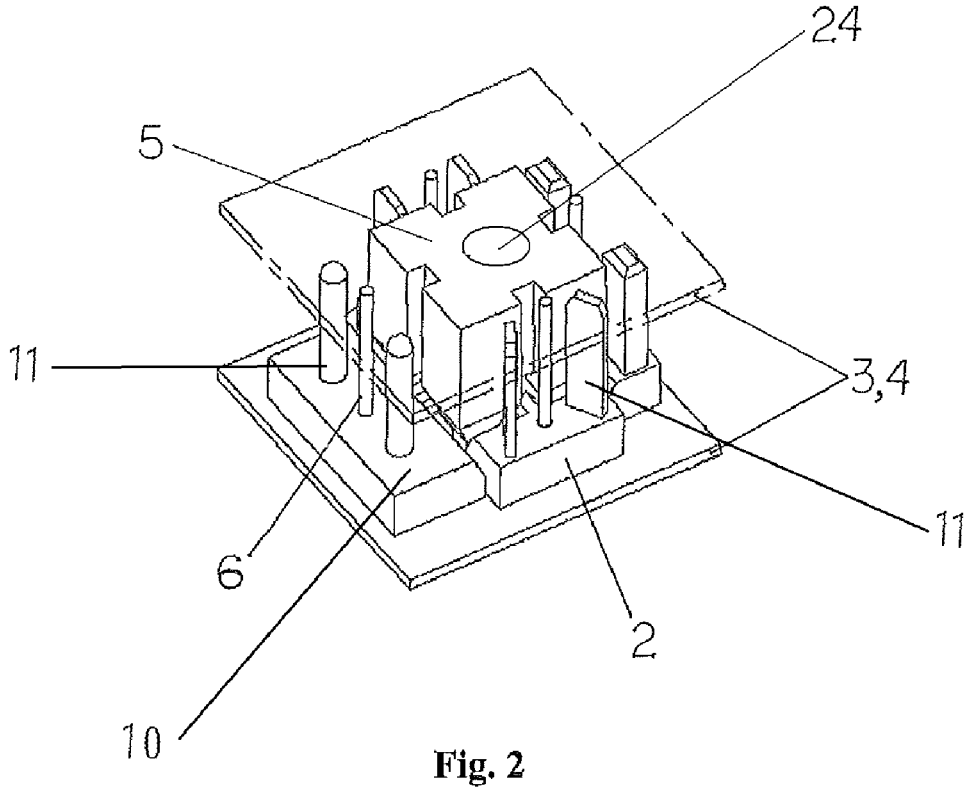
FIG. 2: an internal structural view of FIG. 1.
Figure 3:
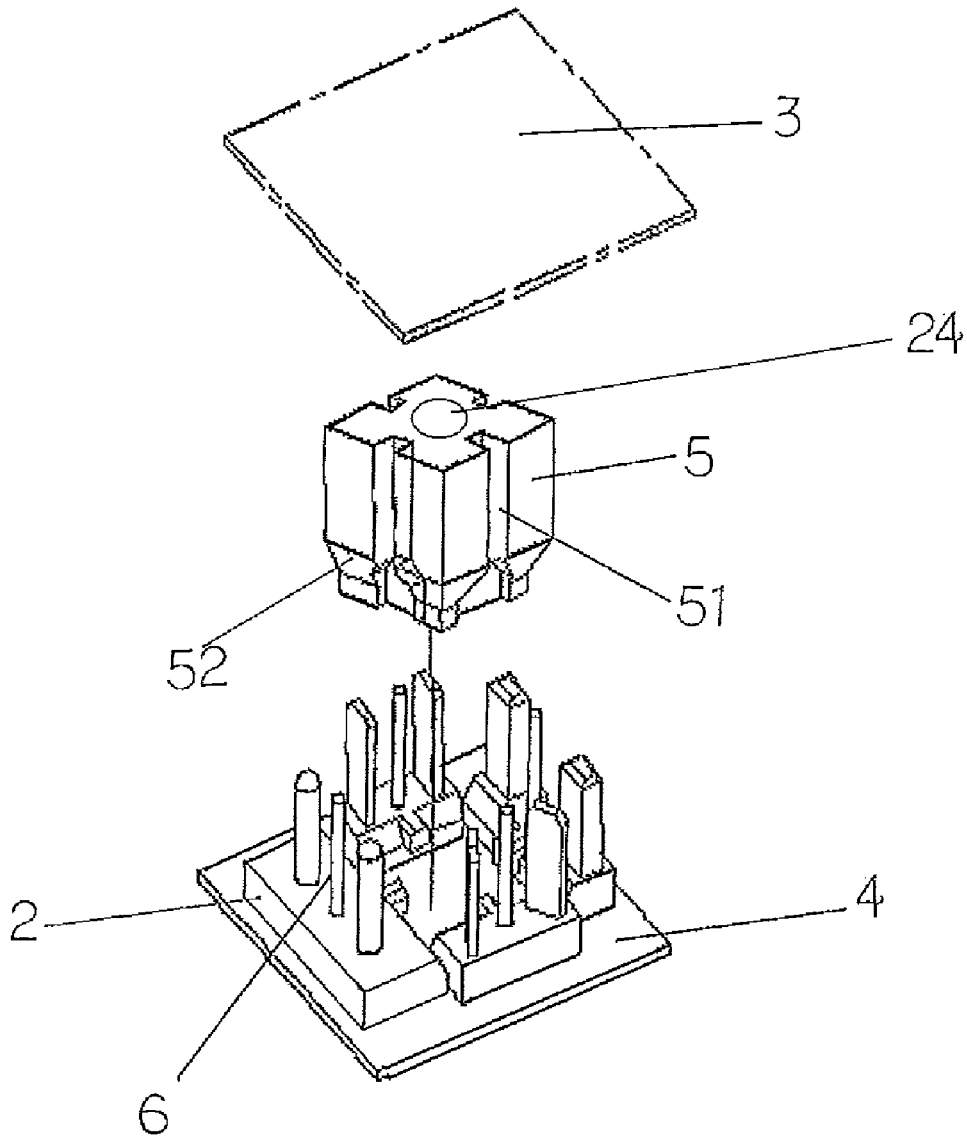
FIG. 3: an exploded view of FIG. 2.
Figure 4:
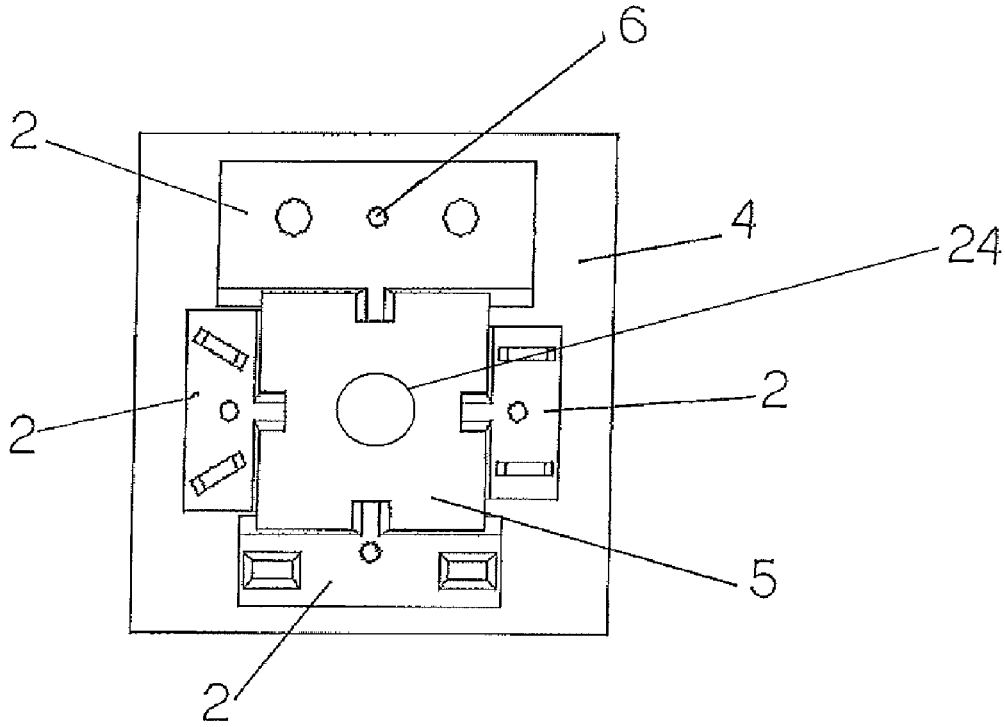
FIG. 4: a top view of FIG. 2.
Figure 5:
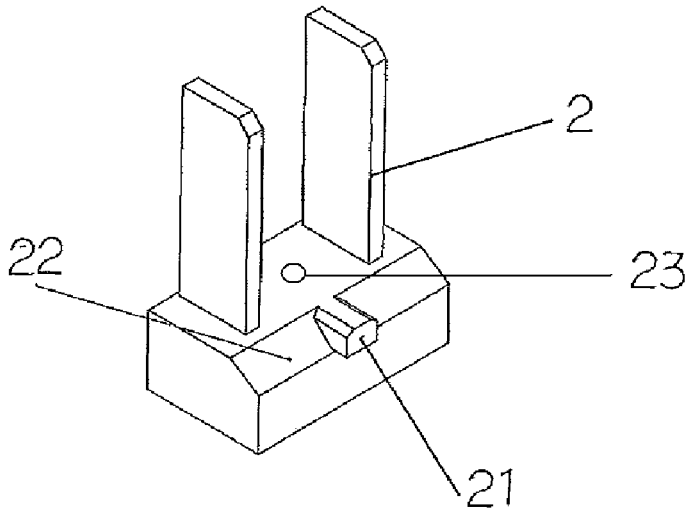
FIG. 5: a structural view of retractable pin of FIG. 2.

The features and the advantages of the present invention will be more readily understood upon a thoughtful deliberation of the following preferred embodiment with reference to the accompanying drawings:

As shown in FIGS. 1~5, present invention of universal plug adapter with multiple retractable pin plugs comprises a main body 1 and four pin plug 2, of which the main body 1 comprises of an upper cover plate 3, a lower cover plate 4, slide slots 13, push nobs 14, and a slide block 5; said main body 1 further comprises an internally placed AC/DC plug module and at least one USB output 12; said lower cover plate 4 is provided with an universal plug socket 41. As shown in FIG. 2, four orientation guide rods 6 are arranged squarely onto the lower cover plate 4, and the four pin plugs 2 are inserted onto each of the four orientation guide rods 6; each of the pin plug 2 comprises of two or three pins 11 mounted onto an insulating body 10; the insulating body 10 is provided with a mounting hole 23 for mounting the pin plug 2 onto the orientation guide rod 6; the slide block 5 is located at the center of four pin plug 2 configuration; the slide block 5 can shift freely in horizontal direction, but shifts slightly in elevation direction under the limitation of upper/and lower cover plates 3, 4; orientation guide rods 6 are used for positioning the pin plug 2 and guiding the direction; the upper and lower cover plates 3, 4 form a space, which is slightly bigger than the height of the slide block 5 to restrict the excessive vertical shift of the slide block 5; As shown in FIG. 3 and FIG. 6*a*~FIG. 6*d*, four grooves 51 are arranged onto four lateral surfaces of the slide block 5; an inner oblique surface 52 is separately set at the lower end of four lateral surfaces; a first groove oblique surface 53 and a second groove oblique surface 54 are set at lower end of the groove 51; the pin plug 2 is provided with bulge 21 mated with the groove 51; the external oblique surface 22 is at the position of the bulge 21; the bulge 21 is located within the groove 51, whilst the external oblique surface 22 and inner oblique surface 52 slide collaboratively, such that the pin plug 2 can be retracted on the slide block 5, and the groove 51 is deep upwards and shallow downwards, as shown in FIG. 7.

Working Principle:

In normal conditions, pin plugs 2 are retracted into the main body 1, and the slide block 5 is located in a free location, enabling free movement without interlocking with any pin plug 2 (the distance between two opposite pin plug 2 is denoted as Lb; and the width of the lower portion of slide block 5 is denoted as La; the distance that slide block shifts horizontally when one pin plug 2 is push is calculated as Lb−La=La); the external oblique surface 22 and bulge 21 of the pin plug 2 are fully positioned below the inner oblique surface 52 of slide block 5, groove oblique surface 53 and groove oblique surface 54 (see FIG. 7).

Figure 8A:
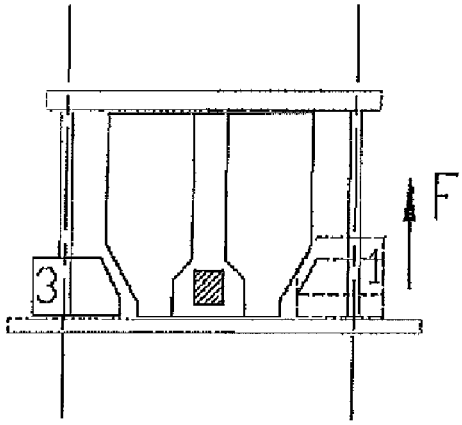
FIG. 8*a*~8*c*: sectional views of FIG. 2 with the movement of slide block.
Figure 8B:
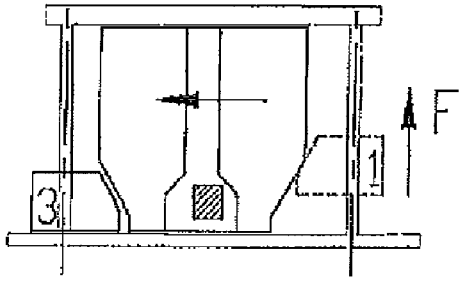
Figure 8C:
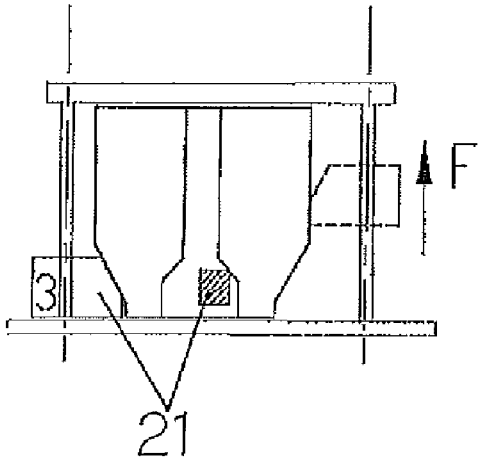

In working conditions, as shown in FIG. 8*a*~FIG. 8*c*, the pin plug 2 is pushed upwards with a force F apply to the push nob 14, the push nob 14 slides along the slide slot 13 and the pin plug 2 is slide along the orientation guide rod 6, and the bulge 21 of the pin plug 2 moves along the groove 51 of the slide block 5; given the different depth of the groove 51, the slide block 5 is pushed to shift horizontally, such that the bulges 21 on other pin plug 2 cannot be aligned with the center of the groove 51, so other pin plug 2 not yet pushed are restricted in original position, only a single pin is working.

In another preferred embodiment, the slide block 5 can be a column, rhombic, and polyhedral shape and is hollow in the center creating a fixing space 24 for a fuse and an indicator.

What is claimed is:

1. An universal plug adapter with multiple retractable pin plugs, comprising: a main body, an upper cover plate, a lower cover plate, at least a set of pin plugs, and at least one orientation guide rod; said orientation guide rod is fixed onto said lower cover plate and defines a fixing space for said pin plugs when said upper and lower cover plate is joined with said main body; furthermore, each of said pin plug is provided with a mounting hole for mounting pin plug onto said orientation guide rod and as such, to allowed said pin plug to move vertically along said orientation guide rod; said pin plug comprising at least a pair of pins mounted onto an insulating body, of which only a single pin plug is allowed to be pushed every time wherein said mounting hole is located on said insulating body; said insulating body is characterized having an external oblique surface; a sliding groove is set laterally onto a slide block; said sliding groove is deep upwards and shallow downwards; said slide block is further provided with an inner oblique surface at lower portion and adjacent to said sliding groove; and said sliding groove is provided with a first groove oblique surface and a second groove oblique surface; said at least a set of pin plugs is further provided with a bulge on the center portion of said external oblique surface and said bulge moves along the sliding groove of said slide block when said pin plug is pushed; given the different depth of said slide groove, said bulge pushes the slide block to shift horizontally, such that restricting bulges on other pin plugs from aligning with the center of said slide groove, and in such, other pin plugs not yet pushed are restricted in original position.

2. The universal plug adapter with multiple retractable pin plugs as claimed in claim 1, wherein said slide block is polygonal and is hollow in the center creating a fixing space for a fuse or indicator.

3. The universal plug adapter with multiple retractable pin plugs as claimed in claim 1 wherein, said slide block is round, and is provided with at least three grooves; each said groove is characterized by having deep upwards and shallow downwards structure.

4. The universal plug adapter with multiple retractable pin plugs as claimed in claim 3, wherein said slide block is round and is hollow in the center creating a fixing space for a fuse or indicator.

5. The universal plug adapter with multiple retractable pin plugs as claimed in claim 1, wherein said main body is provided with a plug socket.

6. The universal plug adapter with multiple retractable pin plugs as claimed in claim 1, wherein said main body is provided with an AC/DC plug module internally, whilst an output of USB is arranged externally.

* * * * *